US005373694A

United States Patent [19]

Clark

[11] Patent Number: 5,373,694

[45] Date of Patent: Dec. 20, 1994

[54] COMBUSTOR SEAL AND SUPPORT

[75] Inventor: Jim A. Clark, Jupiter, Fla.

[73] Assignee: United Technologies Corporation, Hartford, Conn.

[21] Appl. No.: 103,317

[22] Filed: Aug. 9, 1993

Related U.S. Application Data

[63] Continuation-in-part of Ser. No. 977,473, Nov. 17, 1992, abandoned.

[51] Int. Cl.[5] ..... F02C 3/06

[52] U.S. Cl. ..... 60/39.36; 60/740; 60/747

[58] Field of Search ..... 60/39.36, 737, 740, 60/742, 746, 747, 748

[56] References Cited

U.S. PATENT DOCUMENTS

| | | | |
|---|---|---|---|
| 2,908,135 | 10/1959 | King, Jr. et al. | 60/39.36 |
| 3,763,650 | 10/1973 | Hussey et al. | 60/737 X |
| 3,851,465 | 12/1974 | Verdouw | 60/39.36 |
| 4,194,358 | 3/1980 | Stenger | 60/39.36 |
| 4,418,543 | 12/1983 | Faucher et al. | 60/748 |
| 4,548,032 | 10/1985 | Sepulveda et al. | 60/39.06 |
| 4,785,623 | 11/1988 | Reynolds | 60/39.36 |

*Primary Examiner*—Richard A. Bertsch
*Assistant Examiner*—Michael I. Kocharov
*Attorney, Agent, or Firm*—Norman Friedland

[57] ABSTRACT

The radial jets of a fuel nozzle for the combustor of a gas turbine engine are non-axisymmetrically disposed around the tip of the fuel nozzle to distribute the fuel into the swirler unevenly around the circumference to reduce pattern factor.

1 Claim, 3 Drawing Sheets $A \neq X$ $A \neq Y$ $A \neq X$
$A \neq Y$

COMBUSTOR SEAL AND SUPPORT

This invention was made under a U.S. Government contract and the Government has rights herein.

This is a continuation-in-part of prior pending application Ser. No. 07/977,473 filed on Nov. 17, 1992 now abandoned.

CROSS REFERENCE

This invention relates to the subject matter disclosed in my patent application filed on even date and entitled "FUEL NOZZLE WITH ECCENTRIC PRIMARY CIRCUIT ORIFICE" Ser. No. 07/977,476 and assigned to United Technologies Corporation, the assignee common to this patent application.

TECHNICAL FIELD

This invention relates to combustors for gas turbine engines and particularly to the fuel nozzles.

BACKGROUND ART

The fuel nozzles for gas turbine engine combustors typically include a primary fuel circuit and an independent secondary fuel circuit where the secondary fuel circuit is actuated solely during high power engine operation. As is well known the secondary circuit may include its own fuel nozzle or may be included in the fuel nozzle that incorporates the primary circuit.

In the latter configuration, the secondary fuel circuit has been a single orifice concentric with the primary circuit orifice and coaxial with the axis of the tip of the fuel nozzle. Other fuel nozzle configurations include multiple orifices concentrically and symmetrically spaced about the axis of the nozzle tip referred to the industry as radial jets.

Generally, the high power fuel flow enters the burner through the secondary circuit, which typically produces a fuel distribution symmetric about the coincident axes of the air swirler and the fuel nozzle tip. In all of these secondary fuel circuits, it is necessary to achieve fuel spray penetration into the swirling air produced by the fuel nozzle's air swirlers and to prevent swirler-air-induced collapse of the fuel spray. The multiple secondary fuel orifices (radial jets) were an improvement over the single secondary fuel orifice inasmuch as it improved on these requirements. Both the single orifice and radial jet configurations for the secondary fuel, circuit, as mentioned above, produce a fuel distribution just downstream of the fuel nozzle's air swirler in the form of a symmetrical spray.

For a combustor to be efficient and effective the combusted gas medium must exhibit a desirable pattern factor prior to delivering the combusted gas medium to the engine's turbine. Heretofore, one of the methods of reducing pattern factor was to incorporate dilution air holes in the combustor to mix additional air with the products of combustion. Because of the increasing amount of air being admitted into the combustor through the front end, the ability to use the dilution zone air jets to effectuate the pattern factor is diminishing. The problem is exacerbated with advanced gas turbine combustors because of the increased combustor size and airflow.

I have found that I can improve pattern factor for the advanced gas turbine engines by employing radial jets in a judicious manner to tailor fuel distribution during high power so as to lower combustor pattern factor without adversely affecting the spray penetration and the ability to prevent swirler-air-induced collapse of the fuel spray. This invention contemplates locating the radial jets in an asymmetrical pattern to produce fuel spray that is tailored to produce a desired temperature distribution at the end of the combustor just upstream of the turbine inlet.

DISCLOSURE OF INVENTION

An object of this invention is to provide an improved fuel injection of the secondary fuel circuit for the fuel nozzles of a gas turbine engine.

A feature of this invention is to locate the radial jets of a fuel nozzle asymmetrically about the nozzle tip and swirler axes to provide a fuel spray that will produce a given temperature gradient ahead of the engine's turbine section.

Another feature of this invention is to judiciously locate the radial jets of a fuel nozzle to obtain predetermined fuel spreading in the radial and circumferential directions.

The foregoing and other features of the present invention will become more apparent from the following description and accompanying drawings.

BEST MODE FOR CARRYING OUT THE INVENTION

As was mentioned in the description immediately above, in gas turbine fuel systems with separate primary and secondary circuits, fuel enters the combustor through the secondary circuit for high power engine operations. In heretofore known fuel nozzle design the fuel was distributed symmetrically about the coincident axes of the air swirler and the fuel nozzle tip. Such a fuel nozzle is exemplified in U.S. Pat. No. 4,418,543 granted to J. E. Faucher on Nov. 29, 1983 entitled "Fuel Nozzle for Gas Turbine Engine" and is assigned to the assignee common with the assignee of this patent application and is incorporated herein by reference. Suffice it to say that the fuel nozzles serve to distribute the fuel to be combusted in the burner to attain efficient burning and avoid producing smoke and noxious gases that would be injected into atmosphere.

While this invention is utilized in annular combustors, it is to be understood that it is net so limited and that any one skilled in this art will recognize that this invention can be employed in other types of combustors. However, it will be understood that this invention relates to only fuel nozzles that employ a secondary fuel circuit in addition to the primary circuit and that it is operated during the high power regime of the combustor's operating envelope.

Figure 1:
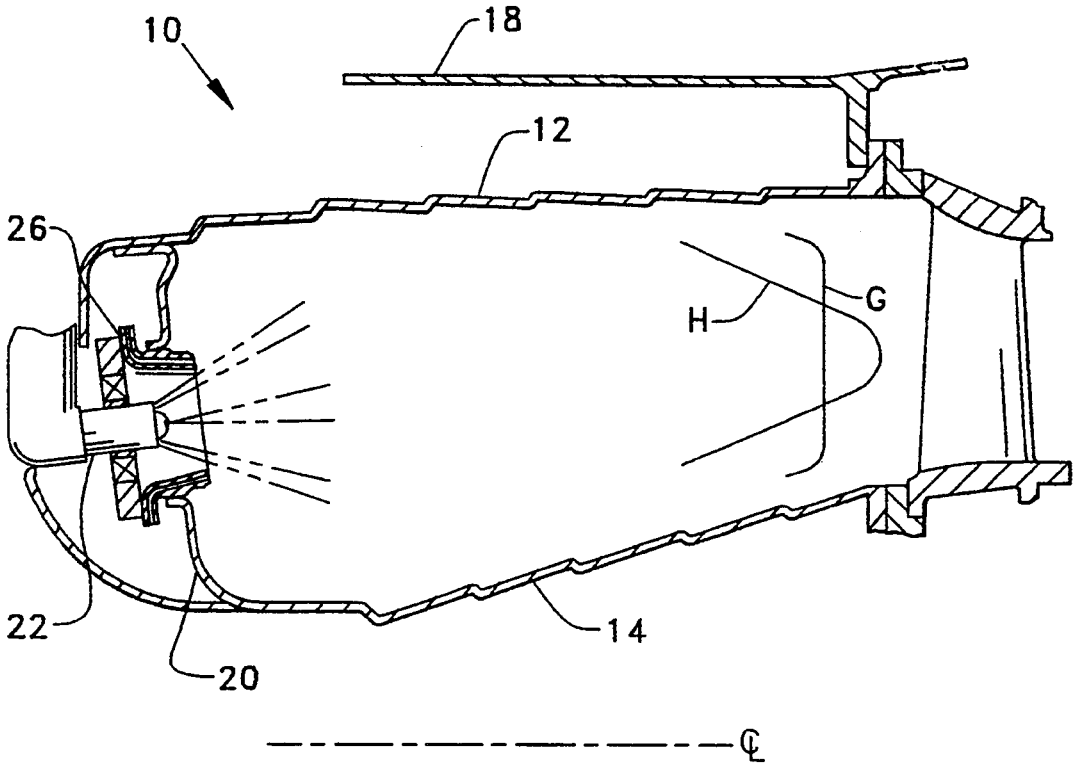
FIG. 1 is a partial view partly in section and partly in schematic illustrating an annular combustor for a gas turbine engine and illustrating the potential temperature profiles utilizing the present invention.

As best seen and shown in schematic form in FIG. 1 the annular combustor generally indicated by reference numeral 10 comprises an outer cylindrically or conically shaped liner member 12 and inner cylindrically or conically shaped liner member 14 defining the combustion chamber 16. While not fully shown, the liner is suitably supported to the diffuser case 18 and the fuel nozzles 22 are supported to dome 20 which is attached to the front end of the liners 12 and 14 forming an end wall. As is customary in these installations, the fuel nozzle is mounted in an air swirler 26 for mixing the air and fuel to obtain efficient combustion. For additional details of the combustor and supporting mechanism reference should be made to U.S. Pat. No. 4,785,623 granted to H. G. Reynolds on Nov. 22, 1988 and entitled "COMBUSTOR SEAL AND SUPPORT" which was assigned to the same assignee as this patent application and which is incorporated herein by reference.

Figure 2:
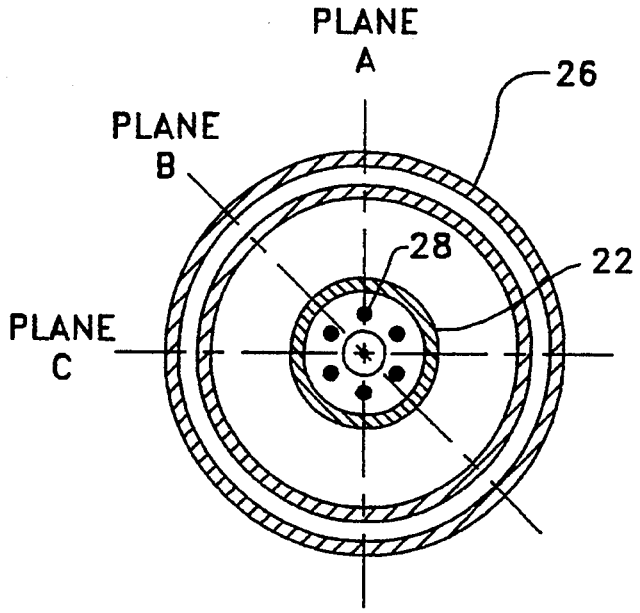
Fig. 2 Prior Art
FIG. 2 is schematic illustration of the secondary fuel circuit of a prior art radial jet fuel nozzle, FIG. 3 are a series of graphs taken through various planes of the radial jet fuel nozzle of FIG. 2 plotting fuel distribution.
Figure 3:
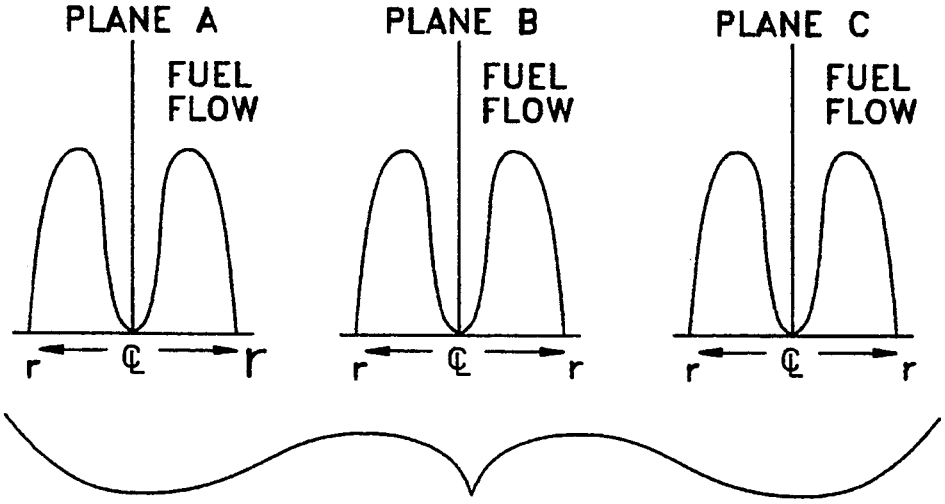
Fig. 3 Prior Art

As was mentioned in the above, in advanced engine technology, the fuel nozzle is designed with a central orifice at the tip for injecting fuel from the primary fuel circuit and radial jets circumferentially spaced around the primary orifice at the tip for injecting fuel from the secondary fuel circuit. The effect of this design can best be seen by referring to the schematic illustration in FIG. 2 and the three (3) graphs shown in FIG. 3. As noted, the radial jets formed around the tip of fuel nozzle 22 which is mounted in swirler 26 are equally spaced around the circumference. Looking at the fuel distribution as illustrated in the three (3) graphs in FIG. 3 which are a plot of the fuel extending from the tip center line radially outwardly through the three (3) planes identified as plane A, plane B and plane C. As can be seen from these graphs the fuel in each of the planes is distributed identically.

Next, comparing this distribution to the distribution obtained from the fuel nozzle designed in accordance with the present invention it will be appreciated that the fuel distribution is different in each of the planes A, B and C. (Like parts in all the FIGS. have the same reference numerals or reference letters)

Figure 4:
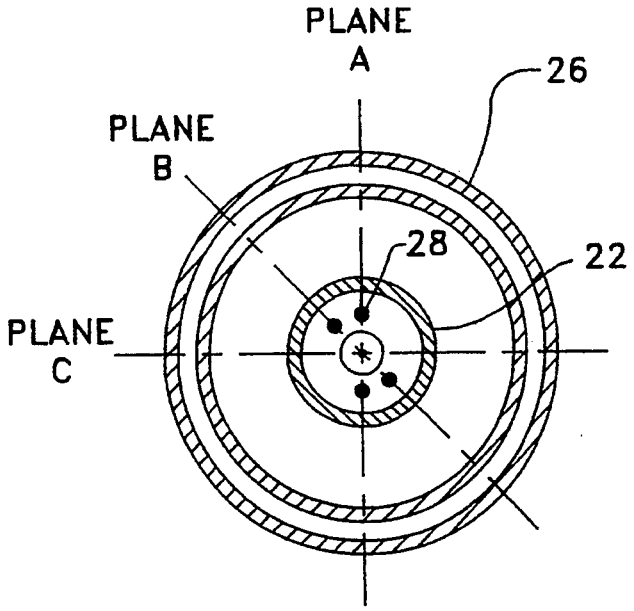
FIG. 4 is a schematic illustration of the secondary fuel circuit of a radial jet fuel nozzle utilizing the invention, FIG. 5 are a series of graphs taken through various planes of the radial jet fuel nozzle illustrate in FIG. 4.

In FIG. 4 the radial jets 28 are nonaxisymmetrically disposed about the circumference of the tip of fuel nozzle 22. Looking at the same planes A, B, and C as those taken through the swirler and tip center line D in FIG. 2, it will be noted that the fuel is distributed unevenly. In accordance with this invention, by judiciously selecting the location of the radial jets, the fuel can be distributed in the burner to produce a more desirable temperature distribution at the exit of the combustor. This effect is shown in FIG. 1 where curve H illustrates the temperature profile generated with conventional radial jets (FIG. 2), and curve g illustrates the temperature profile when the asymmetric radial jets (FIG. 4) are used. When compared with curve G, curve H shows that non-axisymmetric arrangement of radial fuel jets can be used to flatten the temperature profile. There is a relationship between combustion-gas-exit temperatures and pattern factor; the production of a flatter temperature profile reduces pattern factor, i.e., reduce the peakedness. Hence, it is apparent from the foregoing that the number and circumferential locations of the radial jets can be selected to tailor the fuel distribution to reduce pattern factor and improve on combustion effectiveness. While pattern factor is well understood and can be expressed mathematically, for the purposes of this invention it is defined as the measure of difference of maximum and average combustor exit temperature relative to average temperature rise.

This invention also has another advantage in annular combustors by controlling or tailoring fuel spreading. In combustors where the combustor walls were equidistance from the fuel injector axis, fuel spreading was not a factor. Obviously where the wall distances are constant engine-radial and engine-circumferential fuel spreading are identical and fuel spreading needn't be taken into consideration. However, in certain annular burners, radial and circumferential spreading distances are not equal. Obviously, radial spreading distances are determined by combustor dome height and circumferential spreading needs are governed by the distance between adjacent injectors.

It thus follows, that a circular, hollow cone fuel spray of the type emitted from the fuel nozzle disclosed in U.S. Pat. No. 4,418,543, supra, may not be optimal in annular burners. The use of oval shaped swirlers have been attempted to enhance circumferential spreading without affecting radial penetration. However, oval shaped swirler are not desirable for at least two (2) reasons, namely, 1) they are more difficult to manufacture as compared to round swirlers and 2) the air distribution from oval swirlers is not easily managed because of the difficulty in maintaining air angular momentum in a non-circular passage.

Figure 6:
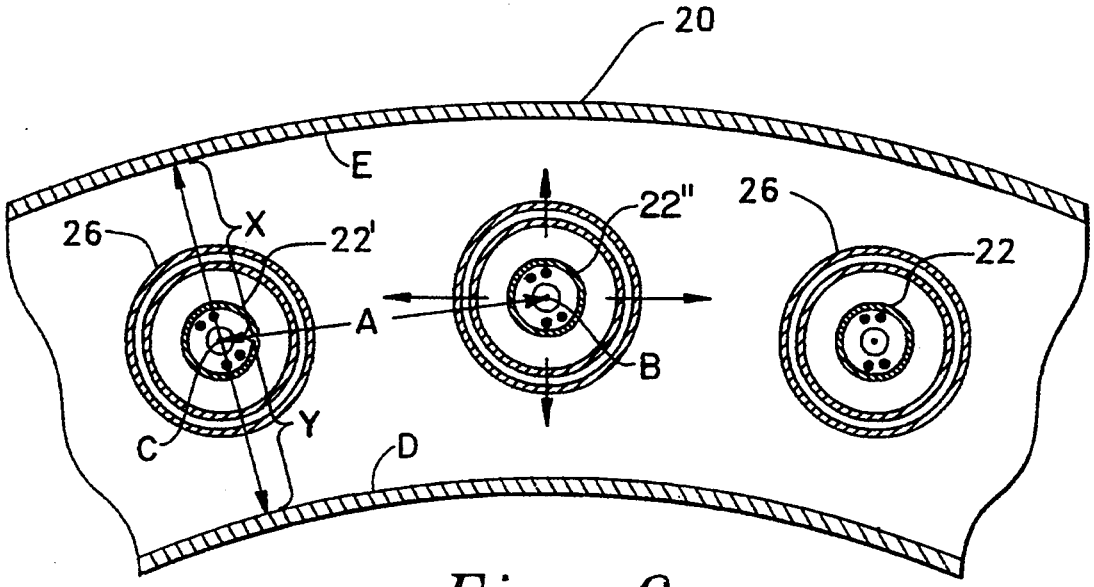
FIG. 6 is a partial view in schematic of a plurality of radial jet fuel nozzles mounted in the front end of the combustor.
Figure 5:
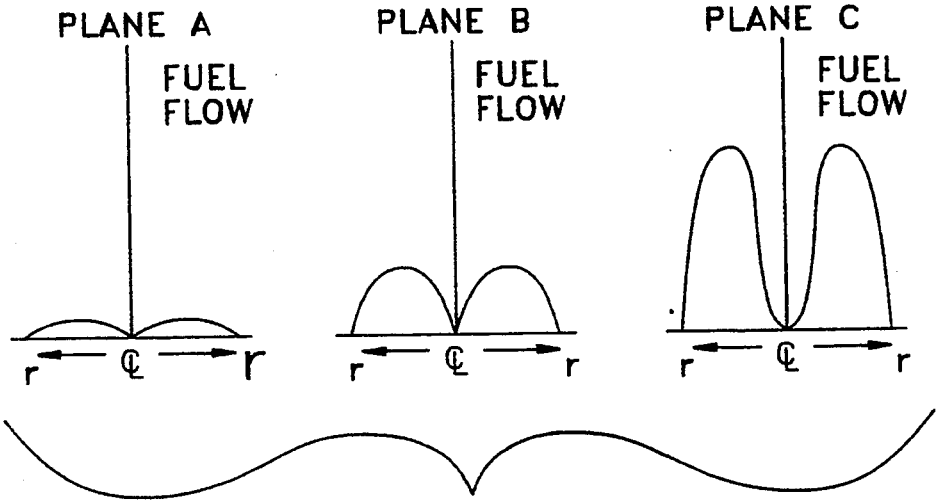

By virtue of this invention the radial jets can be oriented to enhance fuel spreading as is evident by referring to FIG. 5. Referring to FIG. 6 for the moment a plurality of fuel nozzles 22 are circumferentially supported in dome 20. As is apparent the distance between the center lines of adjacent fuel nozzles and the distance from the fuel nozzles center line to the radial walls of the dome are not equal. According to this invention, the radial jets are nonaxisymmetrically spaced around the fuel nozzle's center line to compensate for this difference and even out fuel spreading so as to reduce pattern factor in the combustor by distributing fuel as shown in FIG. 5.

Although this invention has been shown and described with respect to detailed embodiments thereof, it will be appreciated and understood by those skilled in the art that various changes in form and detail thereof may be made without departing from the spirit and scope of the claimed invention.

I claim:

1. A plurality of fuel nozzles, each fuel nozzle having a primary fuel circuit and a secondary fuel circuit for a combustor of a gas turbine engine, said combustor including concentrically disposed inner liner and outer line defining a combustion chamber, a dome mounted on the front end on said inner liner and said outer line for enclosing the front end of said combustion chamber and said dome including apertures for supporting said fuel nozzles, each of said fuel nozzles including a cylindrical body having a front face facing said combustion chamber and a central orifice disposed in said front face at the central axis of the fuel nozzle for leading fuel from said primary fuel circuit to the combustion chamber, means for producing a predetermined pattern factor including a plurality of orifices disposed in said front face radially disposed relative to said central axis of the fuel nozzle for leading fuel from said secondary fuel circuit to said combustion chamber, said radially disposed orifices being disposed non-uniformly around the circumference of said fuel nozzle, so that the flow of fuel from said radially disposed orifices non-axisymmetrically distributes fuel in the combustor to produce a predetermined pattern factor, said fuel nozzles being in circumferential equi-spaced relationship relative to each other where the distance between the central axes of adjacent fuel nozzles is not equal to the distance between said central axis of one of said fuel nozzles to the radial extend of said inner liner or said outer liner so that radial and circumferential fuel spreading distances are unequal, and said means for producing a predetermined pattern factor also for producing an even radial and circumferential fuel spread by distributing the fuel from said secondary circuit of said radial orifices unevenly.

* * * * *